US005877439A

United States Patent [19]

Asakawa et al.

[11] Patent Number: 5,877,439

[45] Date of Patent: Mar. 2, 1999

[54] MUSIC BOX

[75] Inventors: Shinroku Asakawa; Junichi Takemura; Motonori Usui; Makoto Orii, all of Nagano, Japan

[73] Assignee: Sankyo Seiki Mfg. Co., Ltd., Nagano-ken, Japan

[21] Appl. No.: 802,242

[22] Filed: Feb. 19, 1997

[30] Foreign Application Priority Data

Feb. 20, 1996 [JP] Japan ..... 8-032359
Feb. 20, 1996 [JP] Japan ..... 8-032360

[51] Int. Cl.[6] ..... G10F 1/06

[52] U.S. Cl. ..... 84/95.1; 84/94.1; 84/95.1; 84/94.2; 84/95.2

[58] Field of Search ..... 84/94.1, 94.2, 84/95.1, 95.2; 446/297, 298

[56] References Cited

U.S. PATENT DOCUMENTS 4,464,969 8/1984 Isaka et al. ..... 84/95
4,557,173 12/1985 Isaka ..... 84/95 R
4,558,573 7/1984 Isaka ..... 84/95 R
5,179,236 1/1993 Shimotori et al. ..... 84/95.1
5,703,305 12/1997 Isaka ..... 84/95.1

*Primary Examiner*—William M. Shoop, Jr.
*Assistant Examiner*—Kim Lockett
*Attorney, Agent, or Firm*—McAulay Nissen Goldberg Kiel & Hand, LLP

[57] ABSTRACT

A music box comprises a comb having vibrating teeth, a drum having elements for plucking the comb for playing music, a driving source for rotating the drum, a speed governor for regulating rotation speed and a frame for supporting the comb, drum, driving source and speed governor. The speed governor further comprises an accelerating train having two worms and a control device provided on a last row of the accelerating train. A position maintaining element is integrally arranged with the frame for preventing at least the first worm positioned on the driving source side, of the two worms referred to, from moving in the thrust direction. In one form, the music box has a driving source which includes a spring. One end of the spring is engaged with a winding shaft arranged in a spring housing of the spring and the other end is engaged with an engagement section provided on the frame. A contact section is formed on the frame for preventing the other end of the spring engaged with the engagement section from moving out of the spring housing.

12 Claims, 9 Drawing Sheets

FIG. 9
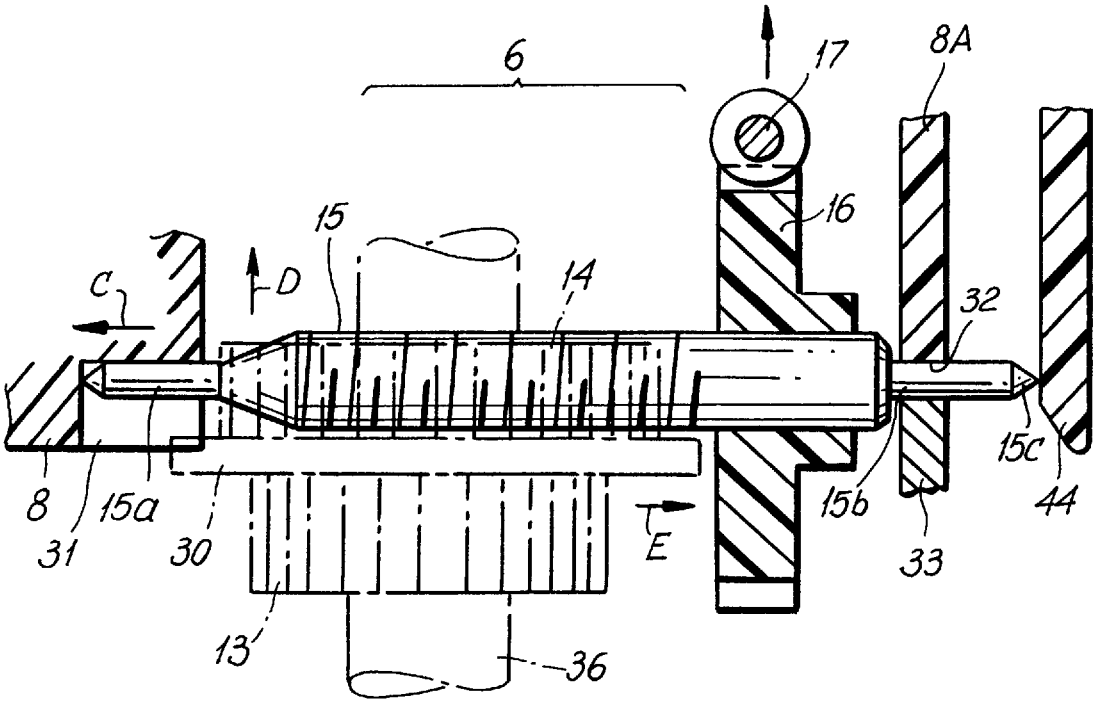
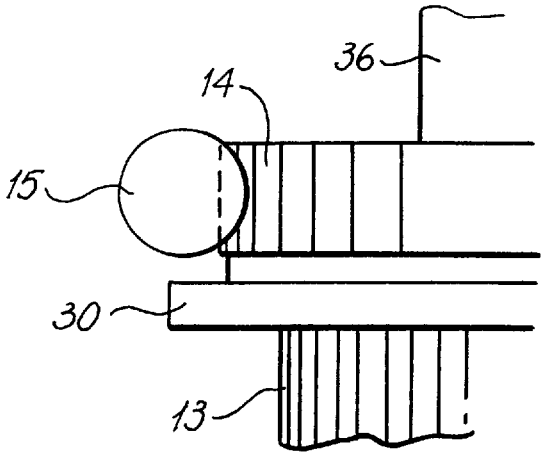
FIG. 10

MUSIC BOX

BACKGROUND OF THE INVENTION a) Field of the Invention

This invention relates to a music box in which pins inserted in a drum pluck teeth which vibrate to produce music.

b) Description of the Related Art

In a music box in which pins inserted in a drum pluck vibrating teeth to produce music, the drum rotation is kept constant by transmitting a driving force from a rotating driving source to a speed governor, via the drum. The governor is used for regulating the drum rotation, and is comprised of an accelerating train and a control means. There is known one such accelerating train in which a plurality of worms and worm wheels are provided in the train due to the associated advantage of having a large acceleration rate. For example, when worms are used in the middle of the accelerating train and in the last row, a brake member is provided in the worm used in the last row to rotate it at high speed, as friction resistance for regulating the drum rotation.

Also, a spring used as a driving source for the drum is wound around a winding shaft and is installed in the space called a spring housing constructed by a frame, case, and the like of the music box. The spring is arranged such that one end is inserted into the spring housing (from the outside of the housing) and engaged with the winding shaft projecting inside of the spring housing, and the other end thereof is engaged with an engagement section formed on the outer circumference of the spring housing, thus preventing the other end from entering in the spring housing while winding the spring. A tie section called necking is formed at the other end of the spring engaged with the engagement section. The tie section is formed with a gap created with the engagement section in the direction the spring extends, taking into account processability at the winding of the spring and at the engaging of the other end; the spring in the housing is tightened when being spirally wound around the winding shaft, and is gradually released by the operation of the speed governor to rotate the drum for the play.

In a music box, a worm is supported with allowance in the shaft direction (generally called a thrust allowance), taking into account the capability of assembling the worm and the tolerance of components. However, the worm is shifted by a deviation force generated in the axial direction when it is given a rotation from a worm wheel and rotated at high speed. The direction in which the deviation force is generated varies according to the input direction of the worm, i.e., the direction the worm rotates. For example, when the input to the worm is transmitted from the driving source side, the deviation force moves in the direction of input by placing tangential stress on the shaft; when the input from the driving source side is decreased and the inertial force of the brake, rotating at high speed, becomes large, the deviation force moves in the opposite direction to the above mentioned direction of input tangential stress.

When the moving direction of the worm varies due to the direction of the deviation force generated in such a way, the gap between the worm and the worm wheel becomes large when switching the directions of the deviation force; therefore, the brake does not function well, freeing the driving source and therefore rotating the drum radically. There would be no problem if the thrust allowance of each worm can be made zero, but it is virtually impossible because of tolerance of components and the like. Even if it could be made zero, a support section for supporting the worm is worn out by the deviation force applied on the worm in the direction the deviation force is applied with some material, thus generating the movement in the thrust direction.

The variation in the drum rotation due to a sudden rotation of the drum causes problems in deteriorating sound quality and making it difficult to hear the music. Specifically, when a plurality of worms are used in the accelerating train, the acceleration rate of the accelerating means is large; therefore, the axial movement of the worm provided in the middle of the train due to the deviation force greatly affects the engagement condition with the worm wheel on the deceleration side.

When a spring is used as a driving source for a drum, if the relationship between a first friction resistance (a friction resistance between the outermost peripheral surface of the spring and the inner peripheral surface of the spring housing) and a second friction resistance (a friction resistance between the outermost peripheral surface and a second outer peripheral surface, inner surface by one wind from the outermost) is broken during release of the spring, i.e., during the play, the spring is not released smoothly, and sometimes the edge engaged with the engagement section moves in the direction to push it out of the spring housing. Under such a condition, a clicking noise is generated between the edge of the spring and the engagement section, causing a noise during the play which is another problem while the music is played. On the other hand, if the relationship between the first and second friction resistance is always maintained such as "the first friction>the second friction", the spring can be smoothly released, without causing a problem; however, it is difficult to maintain the friction resistance in the above mentioned relationship. To obtain such a relationship, many attempts are required, providing poor reliability, requiring a longer time to develop a product, and increasing the manufacturing cost.

OBJECT AND SUMMARY OF THE INVENTION

This invention primarily aims to provide a music box in which problems during play associated with conventional technology is eliminated. In particular, this invention aims to provide a music box in which problems related to playing the music due to variations in the drum rotation are eliminated by preventing the worm from moving in the thrust direction. This invention also aims to provide a music box with a good sound quality in which the other end of the spring is prevented from moving so as to eliminate problems related to the play.

To achieve the above, this invention provides a music box in which a speed governor for regulating the rotation speed of a drum which is rotated by a driving source supported on a frame to play the music by plucking vibrating teeth of a comb is constituted of an accelerating train having two worms and of a brake provided at the leading end of the accelerating train; a position maintaining means is provided on the frame for preventing at least a first worm, positioned on the driving source side, of the two worms, from moving in the thrust direction. Since the gear is prevented from moving in the thrust direction by the position maintaining means, the gap in the accelerating train due to the deviation force can be greatly reduced. Accordingly, the drum is constantly given a braking force by the brake means, rotating with stability and providing a music box with good sound quality.

This invention is also configured such that one end of the spring, a driving source for the drum which plays the music by plucking the comb in an enclosure, is engaged with a winding shaft arranged in the spring housing, the other end of the spring is engaged with an engagement section provided on the frame, and a contact section is formed on the frame for preventing the end of the spring engaged with the engagement section from moving out of the spring housing. Therefore, even if the other end of the spring tries to move out of the spring housing when the friction resistance applied on the spring is changed, its movement can be prevented by the contact section formed on the frame.

BRIEF DESCRIPTION OF THE DRAWINGS

In the drawings:

FIG. 9 is a descriptive drawing showing a supporting structure of the third worm constituting the accelerating train and its relationship with the gears to be meshed with the third worm;

FIG. 10 is a descriptive drawing showing the relationship among the third worm, second worm wheel, and flange;

DESCRIPTION OF THE PREFERRED EMBODIMENTS

Figure 1:
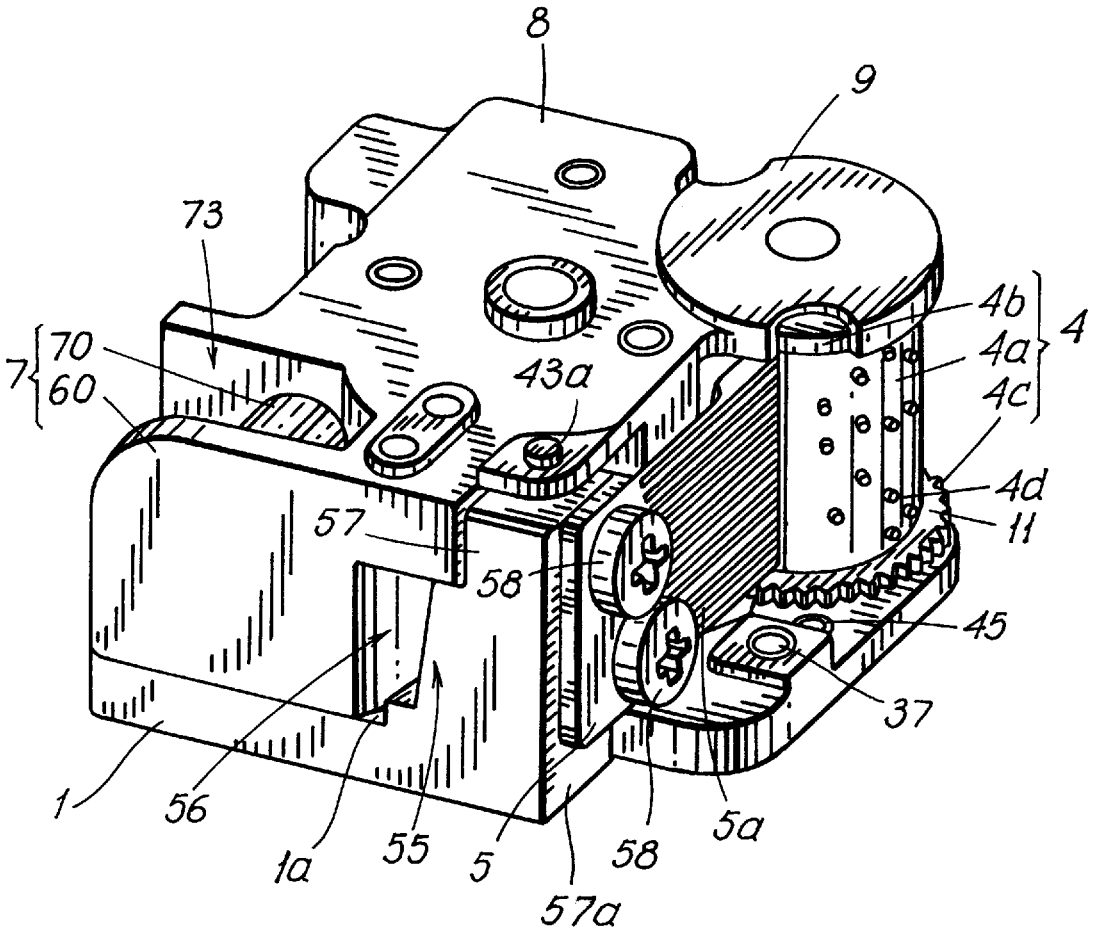
FIG. 1 is a perspective view of a music box showing one embodiment of this invention.

An embodiment of this invention is described in detail referring to the drawings.

A music box shown in FIGS. 1 and 2 has a spring 2 and a shaft 3 for winding up the spring 2 (herein after denoted as "a winding shaft") which are arranged at the center of a frame 1 and has a drum 4, a comb 5 having a plurality of vibrating teeth 5*a*, an accelerating train 6, and a control means 7 (both are speed governors) which are arranged at four corners surrounding the spring 2 and the winding shaft 3. The spring 2, the winding shaft 3, the accelerating train 6, and the like are attached to the frame 1 and covered with a case 8 (an enclosure).

The entire operation of the music box is briefly described. The spring 2, wound up around the winding shaft 3, rotates the winding shaft 3 by stored energy at its release to rotate a first gear 12, a part of the accelerating train 6, integral with the winding shaft 3, then to rotate the drum 4 via a pinion 10 integral with the drum 4. The pins in drum 4 plucks the vibrating teeth 5*a* while rotating to play a music. Also, the rotation of the first gear 12 is transmitted to the brake 7 being accelerated via the accelerating train 6. The brake 7 generates friction resistance using the transmitted rotation to regulate the drum 4 so that its rotation is not exceedingly accelerated, thus stabilizing the rotation of the drum 4.

The frame 1 is made of metal such as zinc alloy and the like, and is molded such that its plane shape is a square. Mounting holes 37 and 38 are formed on the frame 1, and screws and the like are inserted thereto and tightened into a resonant member (not illustrated). In this way, the music box is mounted to the resonant member. The resonant member is made of, for example, wood, metal, or glass. A hole coded by 39 is for mounting a stopper and the like (not illustrated).

On the frame 1 molded of zinc alloy and the like, pins 40*a*, 41*a*, 42*a*, 43*a* for caulking are projected upwardly to be inserted into the mounting holes 40, 41, 42, and 43 provided on the case 8; each of the pins is inserted into each of the mounting holes, and then the heads of the pins are crushed to fix the case 8 onto the frame 1. The case 8 and the frame 1 are connected by caulking the pins; however, screw holes may be formed in place of the pins and machine screws may be used for fixing them.

The case 8 is made of synthetic resin. A spring housing 61 constituting an enclosure for storing the spring 2, a gear housing 62 enclosing the accelerating train 6, a drum support 9 rotatably supporting the drum 4 with respect to the frame 1, and a fixed wall 60 which brakes the accelerating train 6 by making contacts with a rotor 70 of the control means 7. Note that the molding sections of the spring housing 61, gear housing 62, drum support 9, and fixed wall 60 may be formed individually or partially individually, and attached to the frame 1.

Figure 3:
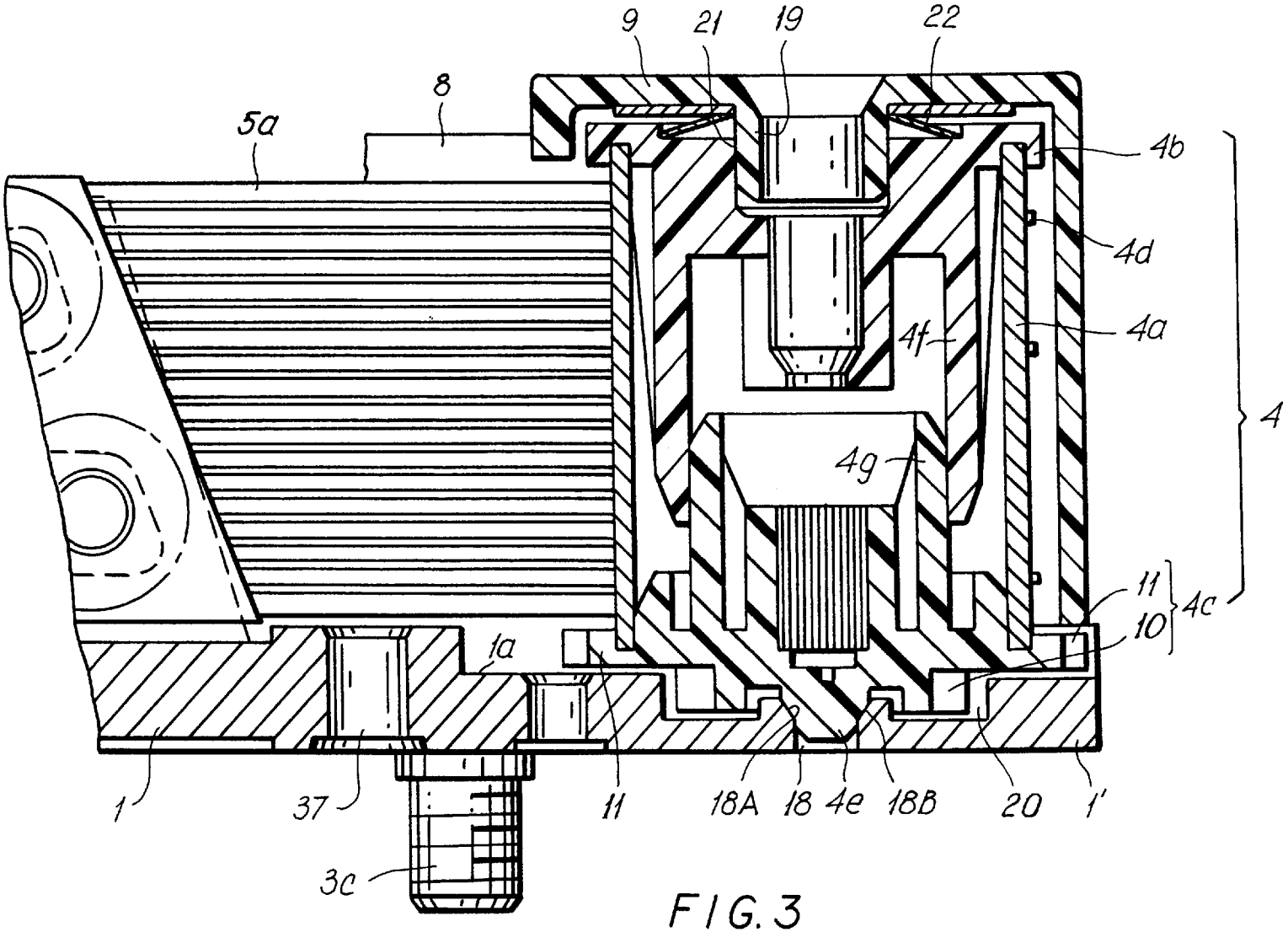
FIG. 3 is a magnified cross sectional view showing a drum and its support structure of the music box shown in FIG. 1.

The drum 4 is arranged on a corner, standing the rotation axis perpendicular to the frame 1 and is rotatably supported by the frame and the drum support 9 projected from the case 8 which is parallel to the frame 1 so that it rotates around the perpendicular rotary center. The drum 4, as shown in FIG. 3, is comprised of a cylinder 4*a* having pins 4*d* inserted around its circumference for plucking the vibrating teeth 5*a*, a top plate 4*b* closing one end of the cylinder 4*a* to constitute a bearing, and a bottom plate 4*c* on which the pinion 10 meshed with the first gear 12 provided on the winding shaft 3 and an output gear 11 for giving out a driving force to a movable member (not illustrated) are formed integrally.

The entire drum 4 is integrated by directly press-fitting the top plate 4*b* and the bottom plate 4*c*. In other words, sleeves 4*f* and 4*g* for press-fitting are integrally molded with the top plate 4*b* and the bottom plate 4*c* and projected therefrom, and the cylinder 4*a* is sandwiched between both plates 4*b* and 4*c*, press-fitting the sleeves 4*f* and 4*g*. With this, both plates 4*b* and 4*c* and the cylinder 4*a* are connected for integration. This can prevent the bottom plate 4*c* from undesired vibrations during the play and increases rigidity of the drum, thus improving the sound quality.

The drum 4 is configured such that a shaft portion 4*e* integrally formed on the bottom plate 4*c* is supported by a drum shaft support hole 18 formed on the frame 1, and the top plate 4*b* is rotatably supported by being press-fitted to a shaft portion 19 projecting downwardly from the drum support 9 which is formed integrally with the case 8. The drum shaft support hole 18 is provided such that the opening on the bottom plate 4*c* side of the drum 4 is made as a tapered hole 18A to support a tapered shoulder 18B formed at the shaft portion 4*e* on the bottom plate 4*c*. On the frame 1 around the drum shaft support hole 18, a concavity 20 for accommodating the pinion 10 is formed one step lower than the frame top surface 1*a*, providing a structure to lower the height in the vicinity of the drum.

A spring member 22 for energizing the drum 4 in the axial direction is interposed between the drum support 9 and the top plate 4*b*; it pushes the drum 4 toward the tapered hole 18A on the frame 1 and gives a constant braking force to the drum 4. The spring member 22 rotatably supports the drum 4 by inserting the cylindrical shaft portion 19 formed inside of the drum support 9 into a hole 21 on the top plate 4*b* of the drum 4. A flat spring is used for the spring member 22 here; however, the application is not limited to this. A frame 1' near the output gear 11 is made slightly larger than the outer diameter of the gear 11, thus preventing damage and the like on the output shaft 11 when the music box is dropped.

Figure 4A:
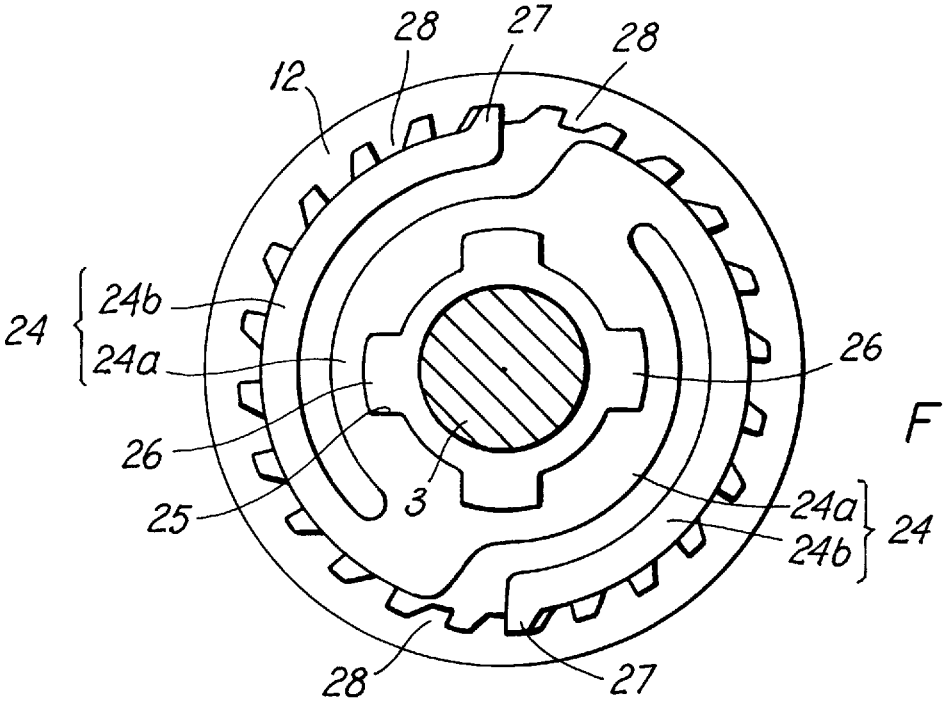
FIG. 4 (A) shows a plan view of one example of a rachet which connects a winding shaft and a first gear.
FIG. 4(B) shows its vertical cross section.
Figure 4B:
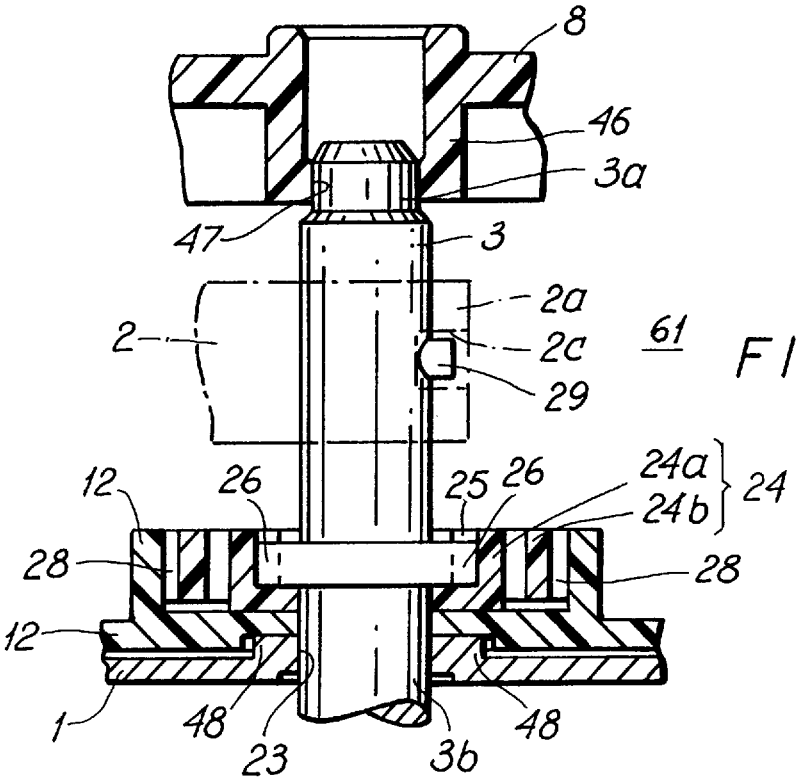

The winding shaft 3 of the spring 2 is arranged at the center of the frame 1 in the spring housing 61, passing through the frame 1, and is rotatably supported by the case 8 and the frame 1. Specifically, as shown in FIG. 4(B), the top end 3*a* of the winding shaft 3 is fitted to and supported by a support section 47 projected from the center of the spring housing 61 and bore in a boss 46 so that it is arranged at the center of the frame 1; the bottom end 3*b* passes through the bearing section 23 formed on the frame 1, projecting outside of the frame 1. To the bottom end 3*b* of the winding shaft 3 which projects outside of the frame 1, as shown FIG. 5, a screw 3*c* is provided, and a base (not illustrated) for a wind key or its substitute is normally mounted thereto.

At the center of the winding shaft 3, as shown in FIG. 4(B), a spring-stopping pin 29 used for the engagement of the inner edge 2*a* of the spring 2 is projected in the radius direction. A hole 2*c* is formed at the inner edge 2*a* of the spring 2, to which the pin 29 is hung, and by rotating the winding shaft 3 in the winding up direction, the spring 2 is wound into the spring housing 61.

The first gear 12 to be connected to the winding shaft 3 is stored in a concavity which is the lowest area in the frame in the same manner as the pinion 10 of the drum 4, and is rotatably supported by a convex 48 formed around the bearing hole 23 on the frame 1. The spring 2 is arranged thereabove.

The winding shaft 3 and the first gear 12 are connected to each other via a rachet 24 so that the rotation is transmitted only in one direction. The rachet 24 is made in an S shape in plane, as shown in FIG. 4(A), for example, and fitted so that an annular section 24*a* at the center is engaged with the winding shaft 3 only in the rotational direction. Here, a concave 25 is formed on the inner circle surface of the annular section 24*a* at every 90°, and is engaged in the rotational direction with a convex 26 formed on the outer circle surface of the winding shaft 3 at every 90°; the winding shaft 3 and the rachet 24 are formed so as to rotate integrally. An arc elastic arm 24*b* of the rachet 24 is formed symmetrical at the facing position; provided at its end are nails 27 which engage with nails 28 formed on the inner circle surface of the boss of the first gear 12 only in one direction. The nails 28 have saw teeth in a normal direction to engage with the nails 27 of the rachet 24 clockwise, and have a slope which prevents, by deforming the elastic arm 24*b* inwardly, the nails from going over the nails 28, and the rotation of the rachet 24 from being transmitted to the first gear 12 when the rachet 24 rotates counterclockwise.

Figure 2:
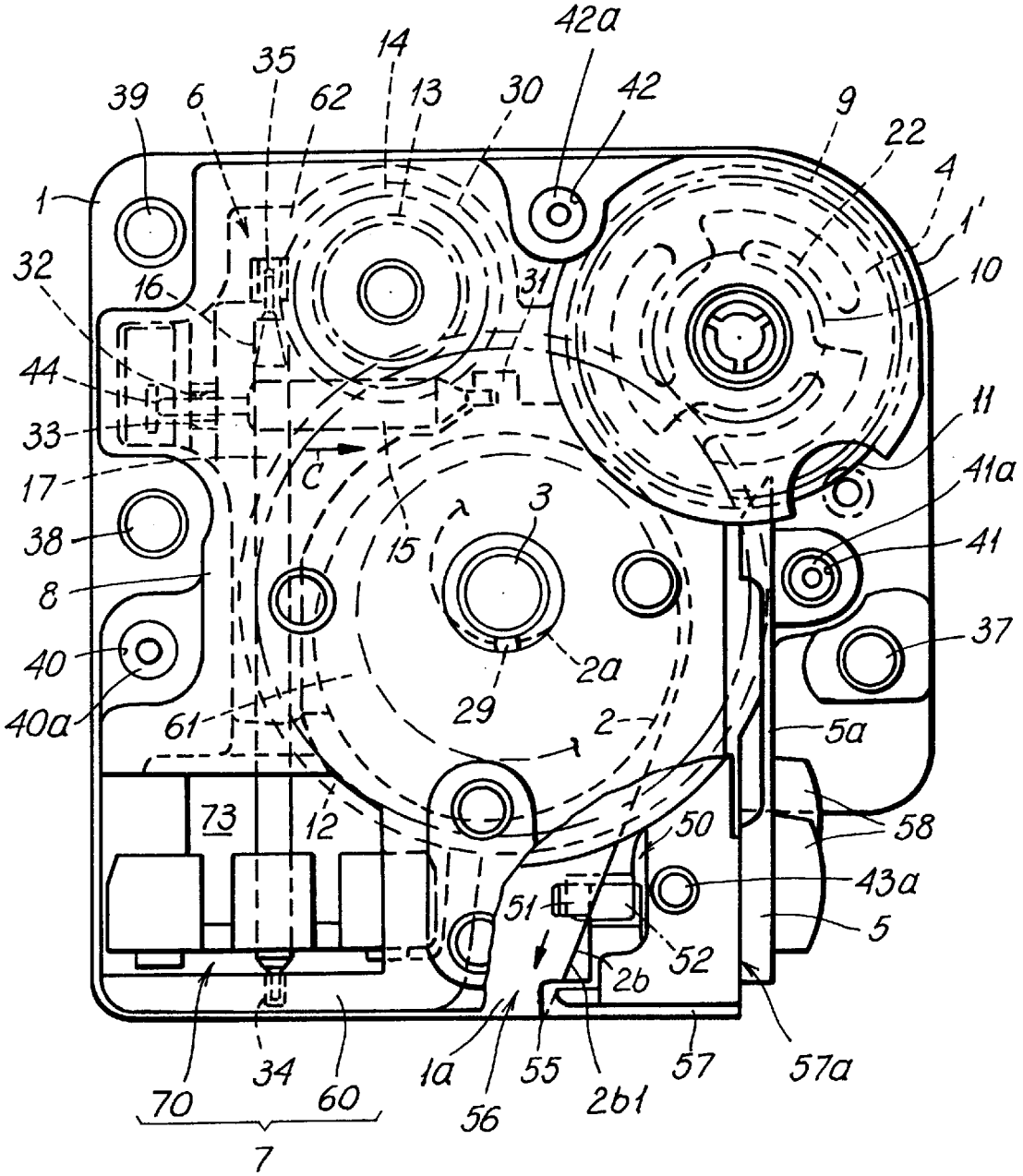
FIG. 2 is a partial cutaway plan view of the music box shown in FIG. 1.
Figure 5:
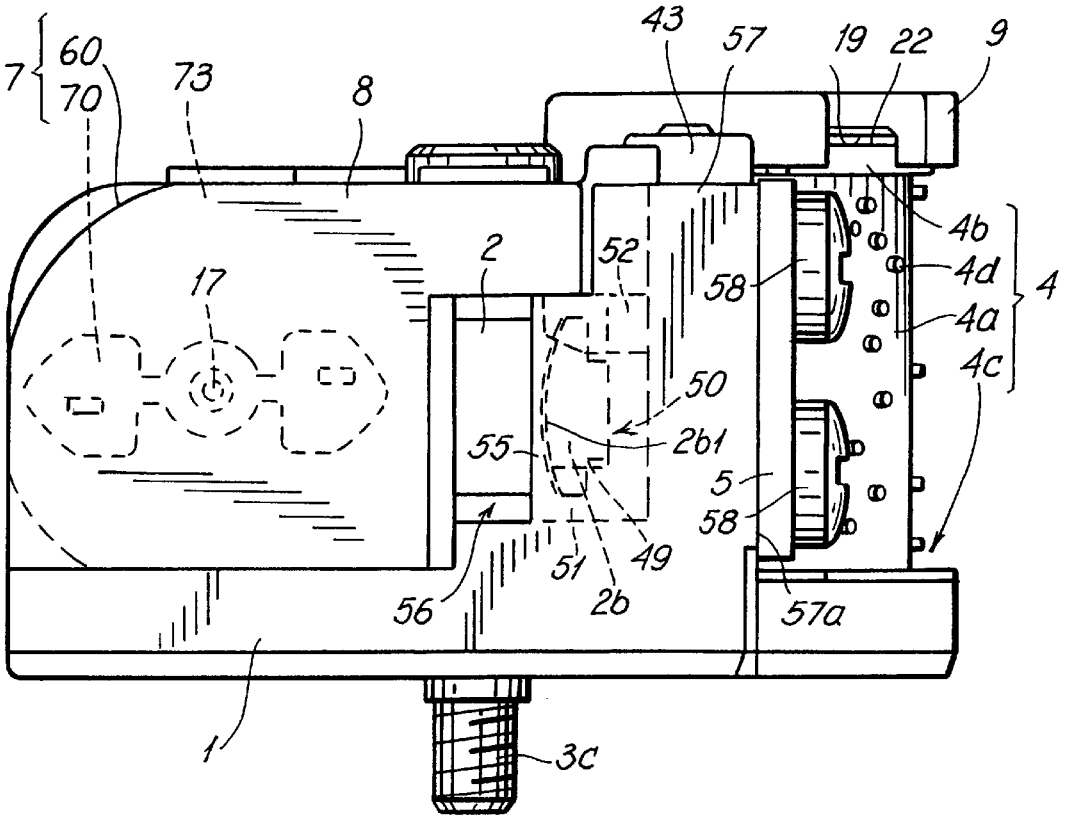
FIG. 5 is a front view of the music box shown in FIG. 1.
Figure 6:
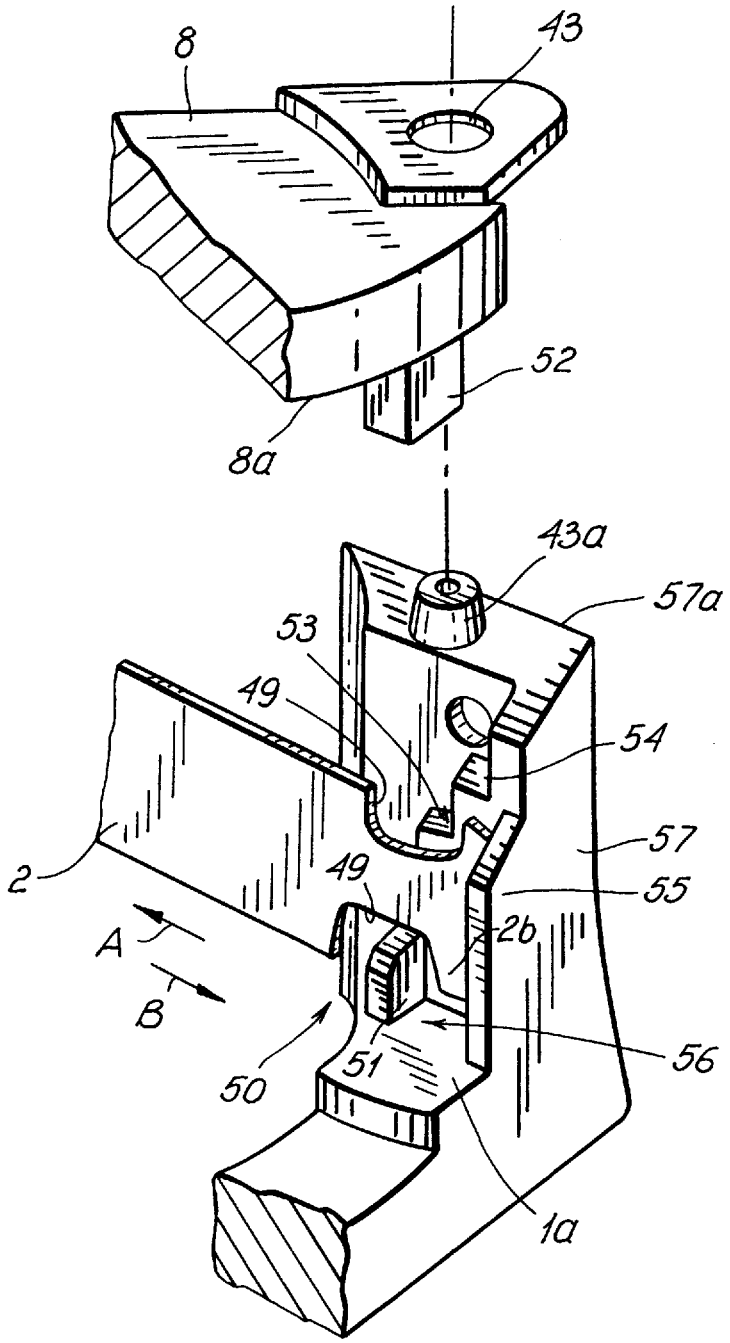
FIG. 6 is a magnified perspective view showing a configuration of the contact section and the engagement section which prevent the other end of the spring from moving outwardly of the box.
Figure 7:
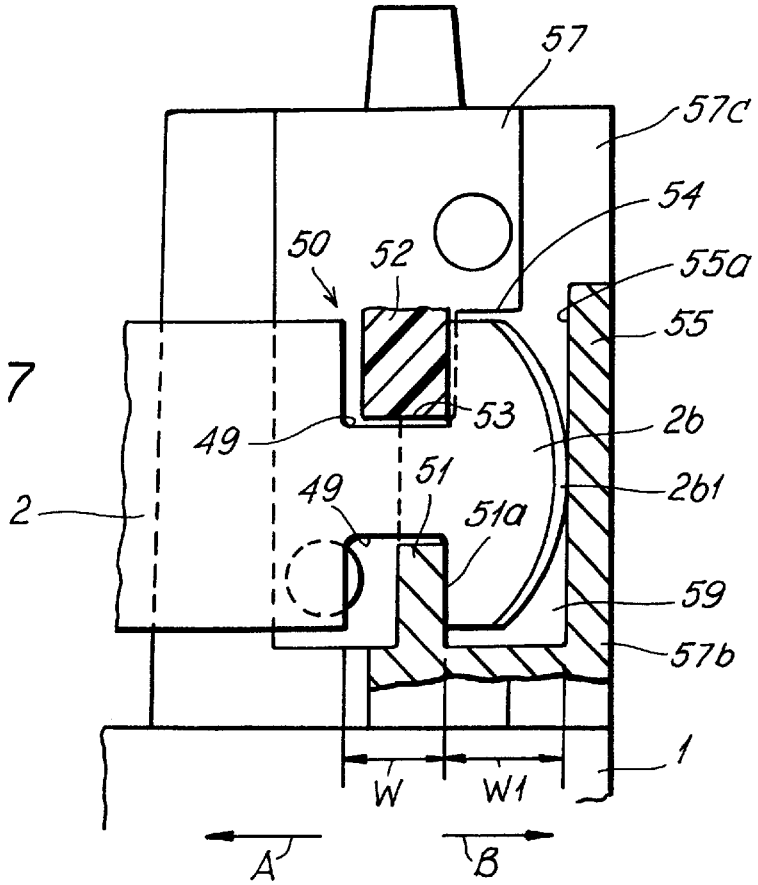
FIG. 7 is a magnified cross sectional view showing an engaging state between the other end of the spring and the engagement section.

The outer edge 2*b* of the spring 2, as shown in FIG. 2, projects outwardly of the spring housing 61, and a tie section 49 called necking as shown in FIG. 5 and 6 are formed there. The tie section 49 is hung to and fixed to the engagement section 50 formed by the case 8 and the frame 1. The engagement section 50 comprises a horizontal rib 51 integrally molded on the top surface 1*a* of the frame 1 and a protrusion 52 molded on the back surface 8*a* of the case 8, and the tie section is hung to the both. These two (the horizontal rib 51 and the protrusion 52) constitute the regulating means for regulating the outer edge 2*b* of the spring 2 from moving inwardly of the spring housing as shown by arrow A (See FIG. 6) against the winding force applied on the winding shaft 3. The horizontal rib 51 and the protrusion 52, as shown in FIG. 7, are formed with narrower width with respect to the width W of the tie section 49 so that the tie section 49 can be smoothly engaged with the engagement section 50 during winding of the spring. Also, formed near the horizontal rib 51 are vertical ribs 53 and 54 for mounting the protrusion 52 and the back surface 8*a* of the case 8.

As shown in FIGS. 5 and 6, in the vicinity of the engagement 50, a seat 57 for mounting the comb 5 is perpendicularly projected from the top surface 1*a* of the frame 1. The comb 5, as shown in FIGS. 1 and 2, is secured by a tightening member such as a machine screw 58 onto the side wall 57*a* of the seat 57, and is arranged vertically with respect to the frame 1 and facing side in the same manner as the drum 4. Therefore, the occupied plane area of the comb 5 on the frame 1 can be within about the thickness of the plate. The comb 5 is arranged such that its top associates with the pins 4*d* on the drum 4, and overlaps the rotational center of the drum 4 under the fixed state on the seat 57, so that the pins pluck the vibrating teeth 5*a* at the position where the drum 4 has a strongest torque. The comb 5 is fixed on the seat 57 such that its high frequency side is positioned close to the frame 1, and accordingly, the drum 4 is arranged such that its high frequency side is near the frame 1 and its low frequency side is on the drum support 9 side.

The seat 57 is integrally molded by casting with the frame 1 in a one-side supporting structure. As shown FIGS. 6 and 7, the above mentioned horizontal rib 51 and the vertical ribs 53 and 54 are integrally molded onto the lower portion 57*b* of the seat 57, and a wall 55 (a contact section) for contacting the top 2*b*1 of the outer edge 2*b* of the spring 2 is molded projecting in the direction orthogonal to the side plate 57*a* to which the comb is mounted, regulating the movement of the outer edge 2*b*. The wall 55 is integrally molded with the lower portion 57*b* of the seat 57 toward the top portion 57*c*, projecting in an L shape to be connected to the frame 1, thus increasing the thickness on the lower side of the seat 57 and the rigidity of the seat 57. The wall 55 is arranged outside the engagement section 50.

Created between the inner surface 55*a* of the wall 55 and the outer surface 51*a* of the horizontal rib 51*a* is a gap 59 whose width W1 is set smaller than that from the top 2*b*1 of the outer edge 2*b* to the tie section 49. For this reason, when the outer edge 2*b* of the spring 2 is placed in the gap 59, it is supported by the horizontal rib 51 and the wall 55 so that the outer edge 2*b* is prevented from moving out of the spring housing as shown by arrow B. Note that the width W1 may be set larger than that from the top 2*b* 1 to the tie section 49. In either case, the wall 55 is arranged outside the top 2*b* 1, in the arrow B direction.

An opening 56 is formed between the wall 55 and the case 8 as shown in FIGS. 1 and 5. The opening 56, as shown in FIG. 2, is in communication with the spring housing 61 to be an insertion slot for the spring 2 into the spring housing 61.

The spring 2 is wound up into the spring housing 61 using the winding shaft 3 after assembling is complete. In other words, the inner edge 2 of the spring 2 is inserted in the opening 56 and engaged with the pin 29 on the winding shaft 3; then the spring 2 is tightly wound up with a mechanically strong torque using an automatic spring winder and the like so that the inner edge 2*a* is not loosened. As the winding of the spring 2 is progressed and the outer edge 2*b* is forwarded into the opening 56, the outer edge 2*b* is pushed toward the engagement section 50 to engage the protrusion 52 and the horizontal rib 51 with the tie section 49, and then the outer edge 2*b* is inserted into the gap 59 as shown in FIG. 7. Consequently, the top 2*b* 1 is held in the gap 59 such that it contacts and detaches from the wall 55 according to the setting condition of the width W1.

Therefore, even when the friction resistance between the spring 2 and the spring housing 61 varies, since the wall 55 is arranged out of the spring housing as shown by arrow B, the wall 55 regulates the outward movement of the outer edge 2*b* from the spring housing (in arrow B direction). For this reason, the energized spring 2 can be smoothly released and the clicking noise generated at the engagement section 50 when the outer edge 2*b* moves can be reduced, providing a music box with less noise. Further, since it does not require many attempts, which is normally required in a method by adjusting friction resistance, it does not take long to develop a product, thus reducing manufacturing cost.

In addition, since the outer edge 2*b* is regulated, its inward movement from the spring housing as shown by arrow A is essentially eliminated, ensuring a smooth release of the spring 2 and reducing the clicking noise created with the engagement section 50.

Since the wall 55 is projected from the seat 57 in an L shape so as to be connected to the frame 1 at the bottom 57*b*, the mass of the bottom portion of the seat 57 increases its rigidity, and the more vibrations from the low frequency side of the comb 5 positioned on the top portion 57*c* side of the seat 57 is transmitted to the frame 1, reducing the deterioration of the volume on the low frequency side. Further, since the comb 5 to be mounted on the seat 57 is supported at its high frequency side, on which the vibration is weak, by the bottom edge 57*b* of which the rigidity is high, the high frequency region can be sufficiently transmitted to the frame 1, thereby obtaining enough volume.

Arranging the winding shaft 3 at the center of the frame 1 provides the balance in the music box, increasing the freedom for rotating the entire music box around the winding shaft 3 projected from the frame 1, or installing the music box to a resonant member.

In addition, since the drum 4 and the seat 57 are arranged vertically, and the vibrating teeth 5 are mounted on the side surface of the seat 57, the occupied plane area of the drum 4 and the comb 5 on the frame 1 is smaller than that in a normal music box in which the rotary shaft of the drum 4 and the vibrating teeth are arranged in parallel to the frame 1, providing a small music box with good sound quality.

Next, the configurations for the accelerating train 6 and control means 7 constituting the speed governor are described.

The accelerating train 6, as shown FIGS. 2 and 8, uses two worms which are mutually orthogonal (hereinafter denoted as "first worm 15" and "second worm 17"), which are arranged around the spring 2 as close as possible and which obtain high acceleration rate. In particular, the rotation reaches high speed at the fourth worm 17 of the final row.

The accelerating train 6 consists of the following: a second gear 13, which meshes with the first gear 12 formed integral with the winding shaft 3 that rotates when the spring 2 (a driving source) is released; a first worm 15, which meshes with a second worm wheel 14 coaxially arranged with the gear 13; and a fourth worm 17, which meshes with a third worm wheel 16 coaxially arranged with the third worm 15. The first gear 12 is also associated with the pinion 10 integrally formed with the drum 4. That is, in this music box, the driving force is separately provided from the spring 2 to each of the drum 4 and the speed governor.

The second worm 17 constitutes the final row of the accelerating train 6, and a rotor 70 of the brake 7 is arranged at the end thereof. The accelerating train 6 configured in this way is covered with the gear housing 62 formed on the case 8, thereby preventing external particles and foreign matters from coming in.

The first worm 15 is arranged closer to the spring 2 (on the decelerating side) than the fourth worm 17 to be a first worm. Also, the first worm 15 is configured such that, as shown in FIG. 9, when the rotation is transmitted from the second worm wheel 14 to the first worm 15, i.e., when the third worm 15 is driven by the driving force of the spring 2, it is pushed to the bearing section 31 formed on the case 8 by the deviation force, which works in the thrust and radial directions as shown by arrows C and D. The bearing section 31 is made as a groove in a reversed U shape, opening downwardly, which regulates the shaft portion 15*a* of the first worm 15 from moving upwardly and sideways.

As shown in FIG. 10, a flange 30 is provided under the second worm wheel 14, and thereby the first worm 15 is supported when the rotation is not transmitted.

Figure 11:
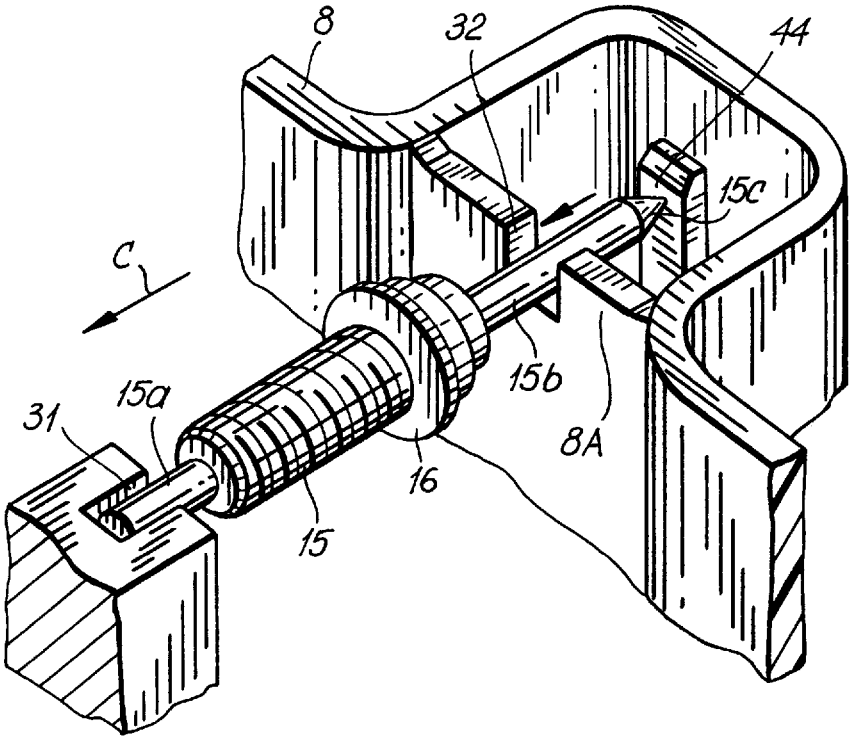
FIG. 11 is a magnified perspective view showing the support structure of the third worm.
Figure 12:
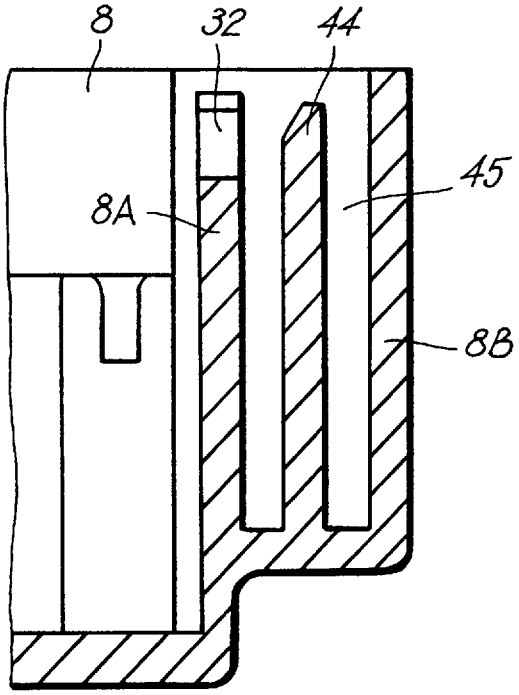
FIG. 12 is a partial cross sectional view of the case, showing a configuration of a position maintaining means.

The shaft portion 15*b* of the third worm 15 formed opposite the shaft portion 15*a*, as shown in FIGS. 9 and 11, is rotatably supported by the bearing section 32 formed in a reversed U shape, with respect to the frame 1, on the inner wall 8A of the case 8 and a convex 33 projected from the frame 1 and fitted to the bearing section 32. Outside the bearing section 32 supporting the shaft portion 15*b*, a tongue piece 44 is integrally formed with the case 8; the tongue piece 44 is a position maintaining member which slightly energizes the first worm 15 toward the bearing section 31 positioned in the direction to which deviation force works, as shown by arrow C. The tongue piece 44 is made of the same resin as the case 8; and as shown in FIG. 12, it is positioned in a gap 45 created by the inner wall 8A and the side wall 8B of the case 8, projecting from the case 8 toward the frame 1, and lightly contacting the shaft edge 15*c* of the first worm 15.

Therefore, even if an allowance is created between the bearing sections 31 and 32 and the first worm 15 for tolerating errors in manufacturing and assembling, since the worm 15 is energized by the tongue piece 44 in the arrow C direction, the worm 15 is prevented from moving in the axial direction. Moreover, although the tongue piece 44 is integrally molded with the case 8 in this embodiment, it may be configured as a separate member from the case 8, and also it may be a plate spring in place of the tongue piece 44. In either case, it is important for the position maintaining member to have elasticity.

In this manner, the first worm 15 can be prevented from moving in the axial direction; therefore, for example, a sudden torque transmission to drum 4 which is normally caused by the movement of the spring 2, is eliminated, and the rotation of the drum 4 is stabilized, making it possible to maintain an excellent playing condition. In particular, two worms 15 and 17 are used in the accelerating train 6 to increase the accelerating rate; therefore, when the stored energy of the spring 2 decreases over time, and the input of inertial force from the brake means 7 positioned on the accelerating side becomes larger than the stored energy of the spring 2, backlash occurs at the engagement of the gears due to the input rotation, making the rotation of the drum 4 unstable. For this reason, it is very important to prevent the first worm 15 from moving in the axial direction. Such an important problem can be solved by providing a certain allowance between the bearing sections 31 and 32 and the third worm shaft 15, resulting in making it possible to assemble the accelerating train 6 smoothly. Further, this provides some range for precision work for the frame 1 and case 8, which reduces manufacturing cost.

Figure 8:
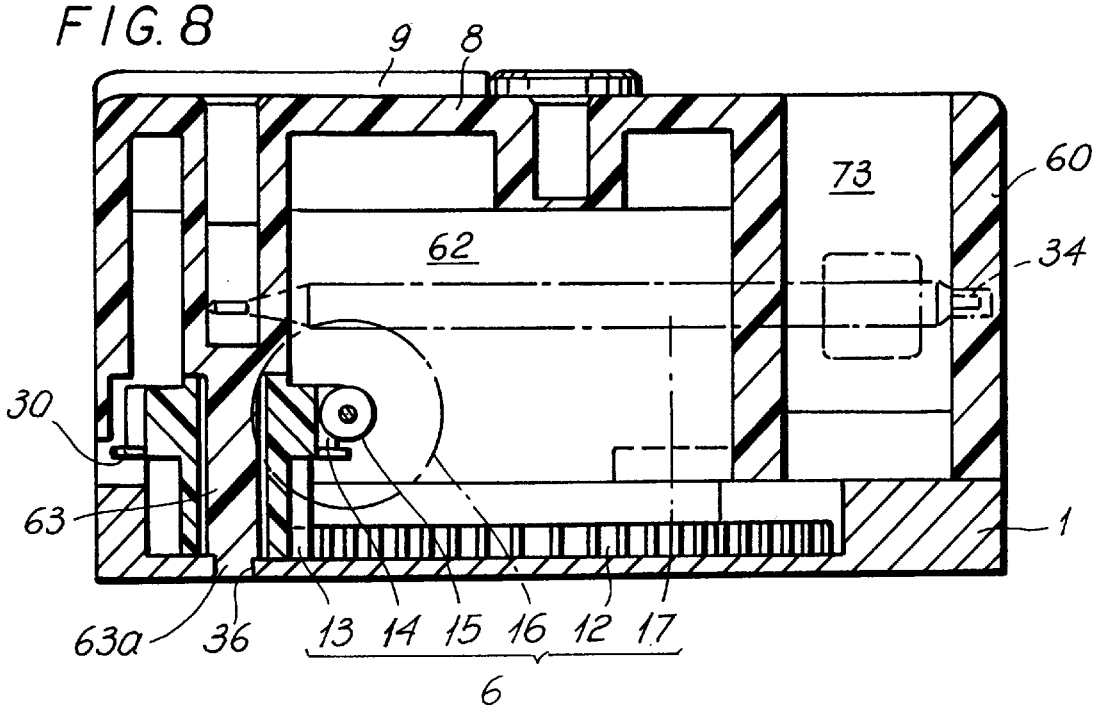
FIG. 8 is a side view showing a configuration of an accelerating train.

At the position at which the third worm 15 and the second worm 17 cross each other, the third worm wheel 16 is formed as shown in FIGS. 8 and 9, and the second worm 17 is arranged thereabove; they are meshed with each other. The second worm 17, as shown in FIG. 2, is rotatably supported such that one end is inserted into the bearing section 34 formed on the fixed wall 60 of the case 8, and the other end is supported by the third worm wheel 16 and the reversed U shape bearing section 35 formed on the case 8.

Accordingly, a projecting member for supporting the other end of the fourth worm 17 from the bottom is not necessary, reducing the number of projections from the frame and lowering the height because the supported position is closer to the frame 1.

The second gear 13, the second worm wheel 14, and the flange 30 are integrally molded of plastic or metal as necessary; as shown in FIG. 8, they are rotatably supported by a shaft 63 which is formed integral with the case 8 and projected to the frame 1 from the case 8. The shaft 63 projects to the frame 1 from a ceiling surface of the gear housing 62. The end 63*a* of the shaft is inserted into a supporting hole 36 bore on the frame 1 and supported by the frame 1 and the case 8; it supports the second gear 13 and the second worm wheel 14 at the position closer to the frame 1.

The brake 7, as shown in FIG. 2, is constituted by a rotor 70 made of elastic body such as rubber or its similar product and a fixed wall 60 with which the rotor 70 makes contacts. The rotor 70 is formed such that it moves in the axial direction when given centrifugal force, and is press-fitted to the shaft portion of the fourth worm 17 which is rotated at high speed. The fixed wall 60 has a wall surface (not illustrated) with which the rotor 70 makes contacts when it moves, such that it provides a friction brake by the contact from the rotor 70 which moves in the axial direction being given a centrifugal force. The friction brake keeps the rotation constant for the accelerating train 6 and the drum 4 connected thereto.

Formed near the fixed wall 60 is an open space for rotatably accommodating the rotor 70; by inserting a stopper and the like (not illustrated) therefrom, it is possible to stop the rotor 70.

According to a music box configured in this way, when the first gear 12 is rotated by the release of the spring 2, the accelerating train 6 accelerates the rotation to rotate the rotor at high speed; then, the rotor 70 makes contact with the fixed wall 60 to brake the rotation of the first gear 12 of the drum 4, maintaining the rotation of the drum 4 constant. At that time, since a weak energizing force from the tongue piece 44 is working on the first worm 15 in the arrow C direction as shown in FIG. 9, the rotation of the first worm 15 is stabilized, preventing the third worm 15 from moving in the axial direction. Besides, a deviation force in the arrow C direction works on the first worm 15 due to the rotation of the gear itself; therefore, the energizing force from the tongue piece can be minimum.

On the other hand, when the meshing load between the drum 4 and the comb 5 is large relative to the stored energy of the spring 2, that is, when the stored energy of the spring 2 is decreased, the inertial force of the rotor 70 mounted to the second worm 17 positioned on the accelerating side is transmitted to the first worm 15 as a driving force. Then, the deviation force in the arrow E direction as shown in FIG. 9 works on the first worm 15 to move it in the right direction in the figure. However, because of the tongue piece 44 contacting the edge 15*c* of the first worm 15, the first worm 15 is prevented from moving in the axial direction. If the deviation force in the arrow E direction generated by the input rotation from the second worm 17 (accelerating side) is large, the third worm wheel 16 contacts the inner wall 8A of the case, thus preventing the damage on the tongue piece 44.

Further, even if the deviation force (as shown by the arrow C) from the spring 2 is larger than that in the arrow E direction, since the third worm 15 is always energized in the deviation direction shown by the arrow C by the tongue piece 44, the meshing condition with the second worm wheel 14 is stabilized. In other words, even if the deviation direction working on the third worm 15 is changed in the opposite direction (the arrow E direction), the tongue piece 44 prevents the worm 15 from moving in the axial direction, lessening backlash in the accelerating train 6. Accordingly, the braking force from the brake 7 is stably transmitted to the drum 4, stabilizing the rotation of the drum 4. The end result is that the playing condition and the sound quality are improved.

Moreover, even if a certain allowance for manufacturing is provided between the bearing sections 31 and 32 and the second worm 15, the tongue piece 44 regulates the movement of the second worm 15. This enables a smooth assembly of the accelerating train 6, resulting in providing a range of precision work for the frame 1 and the case 8 and lowering manufacturing cost.

Although, the tongue piece 44 used in this embodiment is an elastic piece integrally molded with the case 8, it may be made as a separate member and installed later, or it may be provided on the top surface 1*a* of the frame 1 as a single unit or as a separate member; further a plate spring may be used in place of the tongue piece 44. In either case, it is important for the position maintaining member to have elasticity, which improves the durability for the position maintaining member and provides the freedom for the positional relationship with the first worm 15.

According to this invention, even when the deviation direction is changed for the first worm positioned on the driving source side in the accelerating train which has two rows of worms, a position maintaining means prevents the gear from moving in the thrust direction; therefore, backlash in the accelerating train due to the deviation force can be lessened. For this reason, the braking force is constantly given to the drum from the brake means, stabilizing the drum rotation. As a result, a music box with good sound quality can be provided.

Energizing the first worm using the position maintaining means in the deviation direction generated when driven by the driving source stabilizes the regulation of the first worm moving in the thrust direction, thus providing a music box which plays music with good sound quality.

Further, forming the position maintaining means of an elastic piece or a tongue piece makes the contact condition with the first worm flexible, providing a music box which plays music with good sound quality and has improved durability for the position maintaining means.

Also, according to this invention, the contact section is formed on the frame of a music box for preventing the other end of the spring, which is in an engaged state with an engagement section, from moving outwardly of a spring housing; therefore, the other end of spring can be prevented from moving, without adjusting the relationship of the friction resistance between the spring and the box, thus reducing the clicking noise made by the other end, and therefore providing a music box with good sound quality. In addition, since one does not have to make attempts to obtain an appropriate relationship of the friction resistance, the time required for manufacturing can be reduced, thereby lowering the cost of the music box.

Also, providing a regulating means, which regulates the inward movement of the other end of the spring in the spring housing against the winding force applied to the winding shaft, at the engagement section regulates the movement of the other end of the spring inwardly of the box, diminishes the movement of the other end and reduces the clicking noise thereby, and therefore, provides a music box with good sound quality.

Moreover, forming the contact section on the seat which stands on the frame by projecting the seat in an L shape so that it is connected to the frame, expands the seat by the mass of the contact section and increases the strength of the seat with respect to the frame. Therefore, the vibration from the comb fixed on the seat is efficiently transmitted to the frame, providing a music box having excellent sound quality and volume.

While the foregoing description and drawings represent the preferred embodiments of the present invention, it will be obvious to those skilled in the art that various changes and modifications may be made therein without departing from the true spirit and scope of the present invention.

What is claimed is:

1. A music box comprising:

a comb having vibrating teeth;

a drum having means for plucking said comb for playing music;

a driving source for rotating said drum;

a speed governor for regulating rotation speed of said drum;

a frame for supporting said comb, drum, driving source and speed governor;

said speed governor further comprising an accelerating train having two worms and control means provided on a last row of said accelerating train; and position maintaining means being integrally arranged with said frame for preventing at least the first worm positioned on said driving source side, of said two worms, from moving in a thrust direction.

2. The music box as set forth in claim 1, wherein said position maintaining means energizes said first worm in the direction of a deviation force generated when said first worm is driven by said driving source.

3. The music box as set forth in claim 2, wherein said frame has a center, said driving source including a spring, and a winding shaft of said spring being arranged at the center of said frame.

4. The music box as set forth in claim 1, wherein said first worm has a shaft supported by a bearing formed on said frame, and an edge of said shaft contacts an elastic piece which constitutes said position maintaining means.

5. The music box as set forth in claim 4, wherein said elastic piece is a tongue piece integrally molded.

6. The music box as set forth in claim 5, wherein said elastic piece is a tongue piece integrally molded with an enclosure which encloses said driving source integrally formed with said frame.

7. The music box as set forth in claim 1, wherein said driving source is composed of a spring; one end of said spring being engaged with a winding shaft arranged in a spring housing which encloses said spring, and the other end of said spring being engaged with an engagement section provided on said frame; a contact section being formed on said frame for preventing the other end of said spring engaged with said engagement section from moving out of said spring housing.

8. The music box as set forth in claim 7, wherein said engagement section has a regulating member for regulating said other end of said spring from moving inwardly of the spring housing against a winding force applied on said winding shaft.

9. The music box comprising:

a comb having vibrating teeth;

a drum having means for plucking said comb for playing music;

a driving source for rotating said drum;

a speed governor for regulating rotation speed of said drum;

a frame for supporting said comb, drum, driving source and speed governor;

said driving source including a spring;

one end of said spring being engaged with a winding shaft arranged in a spring housing of said spring, and the other end thereof being engaged with an engagement section provided on said frame; and a contact section being formed on said frame for preventing said other end of said spring engaged with said engagement section from moving out of said spring housing.

10. The music box as set forth in claim 9, wherein said engagement section has a regulating member for regulating said other end of said spring from moving inwardly of the music box against a winding force on said winding shaft.

11. The music box as set forth in claim 9, wherein said frame allows a rotation shaft of said drum to be arranged in a direction perpendicular to the frame and a seat for mounting said comb to be formed in the perpendicular direction.

12. The music box as set forth in claim 11, wherein said contact section for preventing said spring from moving is projected in an L shape from said seat, and said seat and said frame being thus integrally formed.

* * * * *